United States Patent [19]

Sussman

[11] 4,041,553

[45] Aug. 16, 1977

[54] HYGIENIC JET

[76] Inventor: Sy Sussman, 740 Princeton Road, Franklin Square, N.Y. 11010

[21] Appl. No.: 603,510

[22] Filed: Aug. 11, 1975

Related U.S. Application Data

[63] Continuation-in-part of Ser. No. 451,885, March 18, 1974, abandoned.

[51] Int. Cl.[2] ..... A47K 3/22; A47K 11/08

[52] U.S. Cl. ..... 4/7; 4/6

[58] Field of Search ..... 4/6, 7

[56] References Cited

U.S. PATENT DOCUMENTS

| | | | |
|---|---|---|---|
| 2,605,477 | 8/1952 | Monserrat | 4/7 |
| 2,826,761 | 3/1958 | Lazarus et al. | 4/7 |
| 2,852,782 | 9/1958 | Sundberg | 4/7 |
| 2,957,180 | 10/1960 | McMullen | 4/7 |
| 3,430,268 | 3/1969 | Zoberg | 4/7 |
| 3,513,487 | 5/1970 | Palarmo et al. | 4/7 |
| 3,570,015 | 3/1971 | Rosengaus | 4/7 |
| 3,577,567 | 5/1971 | Wintercorn | 4/7 |

*Primary Examiner*—Henry K. Artis
*Attorney, Agent, or Firm*—Bauer, Amer & King

[57] ABSTRACT

A bidet attachment for toilet seats comprising a supporting member carrying valve mechanisms adapted for attachment to the toilet employing the toilet seat bolts, and an arcuate tube connected to a source of water and adapted to be rotated under the toilet seat about an axis transverse to the anal-vaginal axis of the user. A nozzle carried by the arcuate tube directs a stream of water along the latter axis and in a direction such that when the tube is in a retracted position the stream is directed into the bowl.

1 Claim, 4 Drawing Figures

HYGIENIC JET

This application is a continuation-in-part of my copending application Ser. No. 451,885filed Mar. 18, 1974 and now abondoned.

The aforementioned abstract is neither intended to define the invention of the application which, of course, is measured by the claims, nor is it intended to be limiting as to the scope of the invention in any way.

BACKGROUND OF INVENTION

1. Field of the Invention

Rectal-vaginal douching devices are of interest for hygienic and medicinal purposes.

Conventional bidets are expensive and require space in the bathroom which often is not available. Accordingly, many douching devices have been proposed which attach to the conventional toilet. One such device is disclosed in the U.S. Pat. No. 3,570,015. This device comprises in arcuate tube connected to a water source. The tube is journaled at each side of a toilet seat to which it is attached to permit it to swing front to back within the toilet bowl whereby an orifice in the center of the arc directs a stream of water toward the axis of rotation which is at right angles to the rectal-vaginal axis of the user and, therefore, provides the desired bathing stream. While generally similar to the device shown in U.S. Pat. No. 3,570,015 the apparatus of the present invention provides a number of important improvements. In this prior patent, in the retracted position of the apparatus, the water stream is directed between the seat and lip of the toilet bowl which is an undesirable condition as it can cause the wetting of the bathroom and the legs of the user. The Applicant has provided an orifice which directs the stream forward of the axis of rotation whereby the stream in the retracted position of the apparatus is directed into the bowl of the toilet.

This feature permits the user to adjust the temperature of the water before exposing his or her body to the stream. This is important in cold climates where heated water must be employed. The patentee of U.S. Pat. No. 3,570,015 is domiciled in Mexico where the water is warm and the patent teaches the deriving water from the supply tank.

In addition the present apparatus provides means for simple installation of the apparatus on an existing toilet and for connecting same to the conventional hot and cold water supply.

SUMMARY OF THE INVENTION

A bidet attachment for conventional toilets is provided. The attachment may be readily installed without any special skills. It comprises a bar having holes adapted to receive the standard toilet seat bolts, whereby the bar is secured to the toilet bowl and an arcuate tube is journaled for rotation from a retracted position under the toilet seat. A nozzle is carried at the center of the arcuate tube and directs water flowing through the tube tangential to a circle coaxial with an axis of rotation. Accordingly, in the retracted position the water will go into the bowl. This permits the user to adjust the water temperature without danger of scalding.

With this and other objects in view the invention consists of the novel features of construction and arrangement of parts which will appear in the following specificaton and recited in the appended claims, reference being had to the accompanying drawing in which the same reference numerals indicate the same parts throughout the various FIGS., and in which:

DESCRIPTION OF THE PREFERRED EMBODIMENT

While generally similar to the device shown in U.S. Pat. No. 3,570,015 the apparatus of the present invention provides a number of important improvements. In this prior patent, in the retracted position of the apparatus, the water stream is directed in space 76 between the seat and lip of the toilet bowl which is an undesirable condition as it can cause the wetting of the bathroom and the legs of the user.

Figure 1:
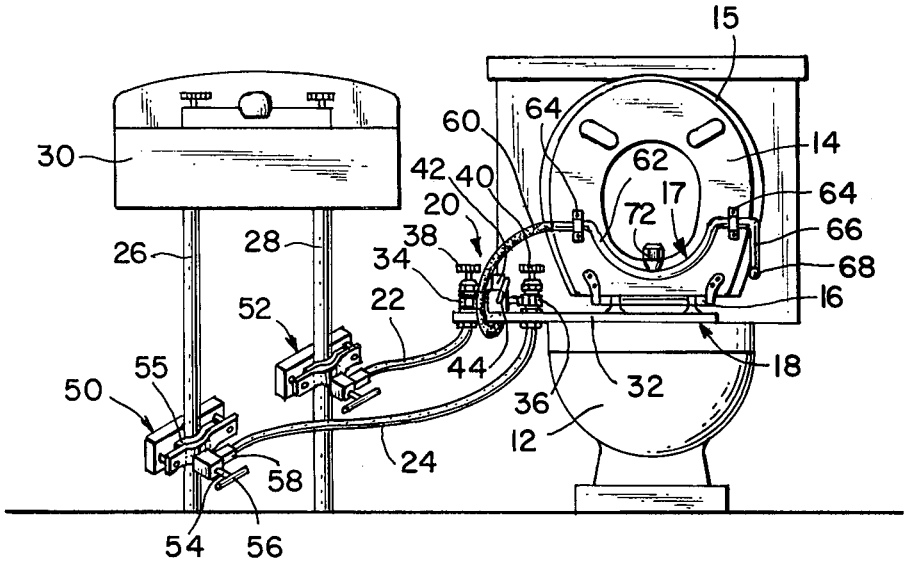
FIG. 1 is an elevational view showing a typical toilet and wash basin arrangement showing the apparatus of this invention attached to the toilet seat in its up position.
Figure 2:
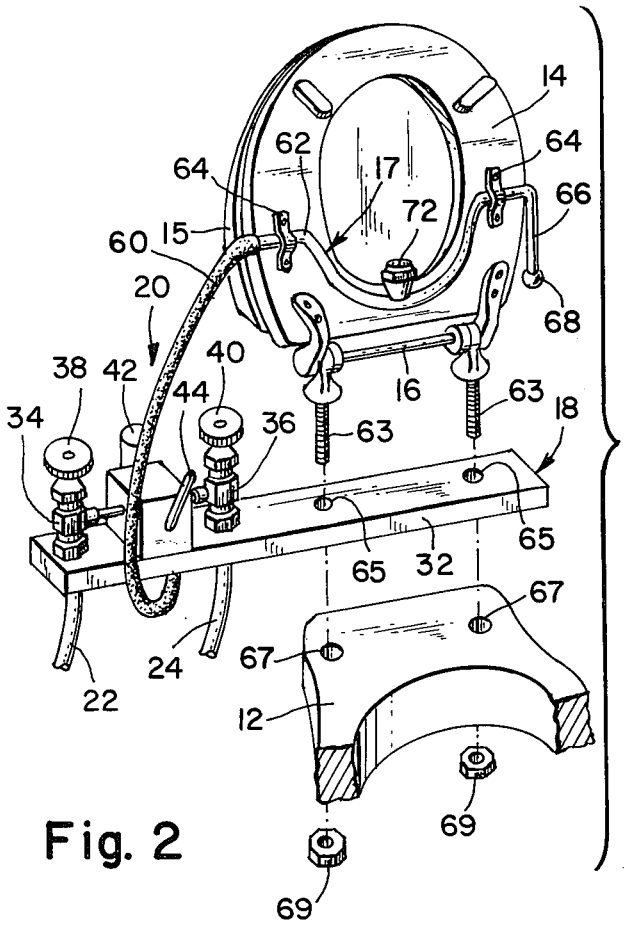
FIG. 2 is an exploded view of the apparatus attached to a toilet seat with the toilet seat in the course of being installed on the bowl.

In FIG. 1 there is shown a toilet bowl 12 and a conventional seat 14 and seat cover 15 pivotally mounted to the toilet bowl by means of bearing members 16. A douching mechanism indicated generally by the numeral 17 is carried on the under side of toilet seat 14. A bracket 18 carries valving mechansisms shown generally by the reference numeral 20 which are connected through flexible hoses 22 and 24 to hot and cold water risers 26 and 28. Such risers are conventionally conveniently available in the bathroom as they feed a wash basin 30.

An apparatus of this type must be readily installed by persons having ordinary mechanical skill. To this end the apparatus comprises a metal mounting plate approximately 14 inches long and approximately 1½ inches wide and a inch thick to which there is mounted valves 34 and 36 provided with handles 38 and 40 for regulating the flow. The apparatus may also include a vacuum breaker 42 which is required by certain municipalities and an on-off control valve 44. However, this valve is optional as will be discussed more fully. Flexible hoses 22 and 24 are preferably connected to so called self-tapping valves 50 and 52. These valves are provided with clamps which clamp the valve and a rubber gasket tightly to the pipes. A lance is provided at the end of a shaft 54 and when the handle 56 is rotated the lance goes through the gasket 55 and pierces the tubing. Handle 56 is now rotated in the other direction permitting water to flow through the right angle connection 58. When the self-tapping valve is used on steel or brass pipe it is necessary to hand drill a small hole in the order of three-sixteenths of an inch and then attach the clamping device. One end of hose 60 connects to one end of arcuate tube 62, the other end with the combined output of valves 34, 36. The other end of tube 62, closed by plug 68 comprises handle 66.

The actual douching apparatus consists of a simple arcuate tube 62 which may be made of copper or brass and nickel or chrome plated or of stainless steel. Alternatively, the tube may be made of plastic such as poly vinyl chloride. Strap members 64 provide journals for rotatably supporting arcuate tube 62.

Figure 3:
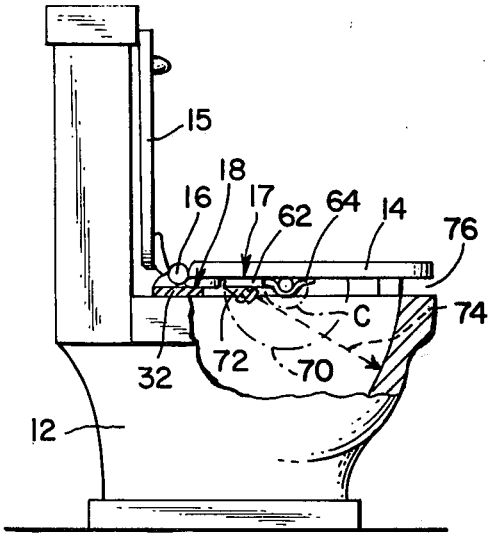
FIG. 3 is a side elevational view of a typical toilet bowl (partially broken away) and seat having the apparatus of this invention installed therein.

From a consideration of FIG. 3 it will be appreciated that as arcuate tube 62 is rotated about its axis along arc 70 the stream of water follows a path tangential to a circle C coaxial with the axis rotation but at all times along the analvaginal axis of the user. Installation of the device is quite simple. Arcuate tube 62 is attached to the bottom of the seat 14 by strap members 64 in which it rotates. Bolts 63 are inserted into openings 65 in bar 32 and holes 67 in the toilet bowl and secured by nuts 69.

In order to use the device the tube is placed in its retracted position with the nozzle 72 directing the stream along line 74 into the bowl. Thereafter the user, either standing or seated, can regulate valves 34 and 36 by means of handles 38 and 40 to obtain a stream of the desired temperature. Then in a seated position the user rotates the arcuate tube 62 from the retracted to the forward position thereby directing a stream along the anal-vaginal axis.

Figure 4:
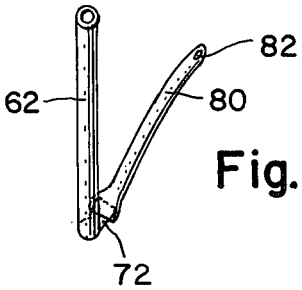
FIG. 4 represents a detail of a douching tube attachment.

For internal douching a flexible hose member 80 FIG. 4 may be snapped over the nozzle 72 and the open end 82 inserted in the vagina. Nozzle 72 is preferably of a removable type to permit of cleaning of the orifices. This feature is important in areas where water conditions result in encrusting of small opening.

In many localities a vacuum breaker 42 is required by ordinance to be inserted in the line.

If desired a valve 44 having inputs from the valves 34 and 36 may be provided to permit shutting off the flow of water without changing the settings of the valves.

It is desireable the nozzle be set to direct thestream at an angle of about 18° below the plane of the axis of revolution when the device is in the retracted position. This insures that during the normal water temperature adjustment period engaged in by the user that the stream will be directed into the bowl.

Thus, an easily installed douching apparatus is provided which is safe to use and which avoids the possibility of invertently scalding the user in sensitive area. Further the apparatus of this invention is easily installed, is rigid and unobtrusive.

What I claim as new and desire to secure by Letters Patent is:

1. A douching attachment for a toilet bowl having a hinged toilet seat including bolts for mounting the seat upon the toilet bowl comprising:

a. a mounting bracket containing bolt holes appropriately spaced for mounting upon the toilet seat bolts;

b. first and second valve means, each having an input port for connection to a water source and an output port mounted on said bracket;

c. Tee means interconnecting the output ports of said first and second valve means to provide a single unitary output port;

d. a tube having a pair of spaced colinear sections joined by an arcuate tube section and a right angle closed terminal section extending from one of the colinear sections and a flexible tube joining the end of the other of the colinear sections;

e. journal members for rotatably securing the colinear sections to the underside of the toilet seat for movement in a plurality of positions from a retracted position under a rear portion of said seat to a forward position adjacent to the front of said seat; and f. a nozzle extending from the middle of the said arcuate section and in communication with the interior therewith, said nozzle being oriented to direct a stream of water at an angle of about 18° below the axis of rotation of said tube and tangential to a circle coaxial with the axis of rotation of the tube, said tube being closed at one end and having means for connection at its other end to a source of water, the curvature of said tube being such that it may be retracted completely beneath said rear portion of the seat and in the retracted position the stream is directed within the bowl.

* * * * *